US005607298A

United States Patent [19]

Tanaka

[11] Patent Number: 5,607,298

[45] Date of Patent: Mar. 4, 1997

[54] CONVEYABLE HEATING APPARATUS

[75] Inventor: Shigehiro Tanaka, Kyoto, Japan

[73] Assignee: Tanaka Giken Co., Ltd., Kyoto, Japan

[21] Appl. No.: 418,117

[22] Filed: Apr. 6, 1995

[51] Int. Cl.[6] ..... F27B 7/14

[52] U.S. Cl. ..... 432/118; 432/105; 366/45

[58] Field of Search ..... 432/105, 118; 366/24, 25, 45

[56] References Cited

U.S. PATENT DOCUMENTS

| | | | |
|---|---|---|---|
| 3,429,561 | 2/1969 | Maxon | 366/45 |
| 5,335,989 | 8/1994 | Tanaka | 366/25 |

FOREIGN PATENT DOCUMENTS

| | | | |
|---|---|---|---|
| 242368 | 1/1987 | Germany | 366/45 |

*Primary Examiner*—Noah P. Kamen

*Attorney, Agent, or Firm*—Cushman Darby & Cushman Intellectual Property Group of Pillsbury Madison & Sutro LLP

[57] ABSTRACT

A conveyable heating apparatus which is operable in a working place of repairing a paved road and can be carried on a vehicle. An asphalt-reclaiming apparatus 1 embodying one example of the heating apparatus comprises a combustion chamber 2 having an open top, a holding frame 3 supporting the combustion chamber 2, an oil pressure motor for rotating the combustion chamber 2, a stand S pivotally supporting through the holding frame 3 the combustion chamber 2, and an oil pressure cylinder 6 for effecting the inclination of the combustion chamber 2. The holding frame 3 is composed of a rear frame 3*a* disposed behind the combustion chamber 2, a lower frame 3*b* extending downward from the both ends of the rear frame 3*a*, and a pair of lateral frames 3*c* horizontally extending respectively from the rear frame 3*a* toward both sides of the combustion chamber 2. The combustion chamber 2 can be rotated by the oil pressure motor 4 and inclined by the action of the oil pressure cylinder 6.

2 Claims, 3 Drawing Sheets

CONVEYABLE HEATING APPARATUS

BACKGROUND OF THE INVENTION

1. Field of the Invention

This invention relates to a conveyable heating apparatus which is adapted to be used for heating and melting in situ pieces of asphalt removed from a paved road in the repair of underground piping or cable systems buried under the paved road, or combustible waste materials to be discarded from industries, and in particular to a conveyable heating apparatus which can be carried on a vehicle such as a truck and moved to any desired working place.

2. Description of Related Art

In the repair of underground piping or cable system buried under a paved road, the asphalt on the paved road is required to be removed in the beginning and then earth under the asphalt is dug out to expose the piping or cable system. Pieces of asphalt thus removed are thrown away and the dug-out road is finally restored to its original state after finishing the repair of the piping or cable system with new asphalt. Meanwhile, there has been proposed to reuse such removed pieces of asphalt for the restoration of a road after finishing the repair of the piping or cable system with the aim of saving the natural resources. For the purpose of reusing such removed pieces of asphalt for the restoration of road in situ, there has been proposed a small asphalt-reclaiming apparatus which can be carried on a vehicle.

It is required with such an asphalt-reclaiming apparatus that a combustion chamber of the apparatus be revolved during a heating operation and inclined to a sufficient degree to allow the pieces of asphalt to be easily thrown into the combustion chamber and to allow a molten asphalt to be easily taken out of the chamber. For example, Japanese Utility Model Publication H4-55054 discloses a small asphalt-reclaiming apparatus comprising an annular gear wheel formed around the outer peripheral wall of a combustion chamber, a driving gear wheel engaging with the annular gear wheel for rotating the annular gear wheel, a follower disposed to face the driving gear and to perpendicularly engage with the annular gear wheel, and an operating member for rotating a pivot shaft integrally connected to the axis of the follower. However, this conventional apparatus has drawbacks in that it is rather complicated in structure and the inclining movement thereof is not smooth.

SUMMARY OF THE INVENTION

Accordingly, the object of the present invention is to provide a conveyable heating apparatus which can be carried on a vehicle such as a truck and the combustion chamber is capable of being rotated and inclined easily.

Specifically, according to the present invention, there is provided a conveyable heating apparatus comprising:

a combustion chamber having an open top, a holding frame consisting of a rear frame disposed behind the combustion chamber in such a manner as to traverse the center of the back surface of the combustion chamber and a pair of lateral frame members formed integrally with the rear frame and extending respectively toward each side of the combustion chamber, a rotatable shaft extending from the bottom of the combustion chamber for revolving the combustion chamber, the rotatable shaft being adapted to be rotated by a driving device, a stand pivotally supporting the lateral frame members of the holding frame, and an inclining means disposed between the stand and the holding frame for inclining the combustion chamber upwardly or downwardly.

According to the conveyable heating apparatus of this invention, it is possible to rotate the combustion chamber through the rotatable shaft to be actuated by the driving device. In this case, if guiding rollers are provided in a manner to support the combustion chamber, a stable rotation of the combustion chamber around the rotatable shaft fixed to the bottom of the combustion chamber can be realized. At the occasion of throwing a material to be heated such as pieces of asphalt into the combustion chamber as well as upon discharging a heated product from the combustion chamber, the combustion chamber can be easily inclined upward or downward by actuating the pivotal movement of the holding frame attached to the combustion chamber.

DESCRIPTION OF THE PREFERRED EMBODIMENT

Figure 2:
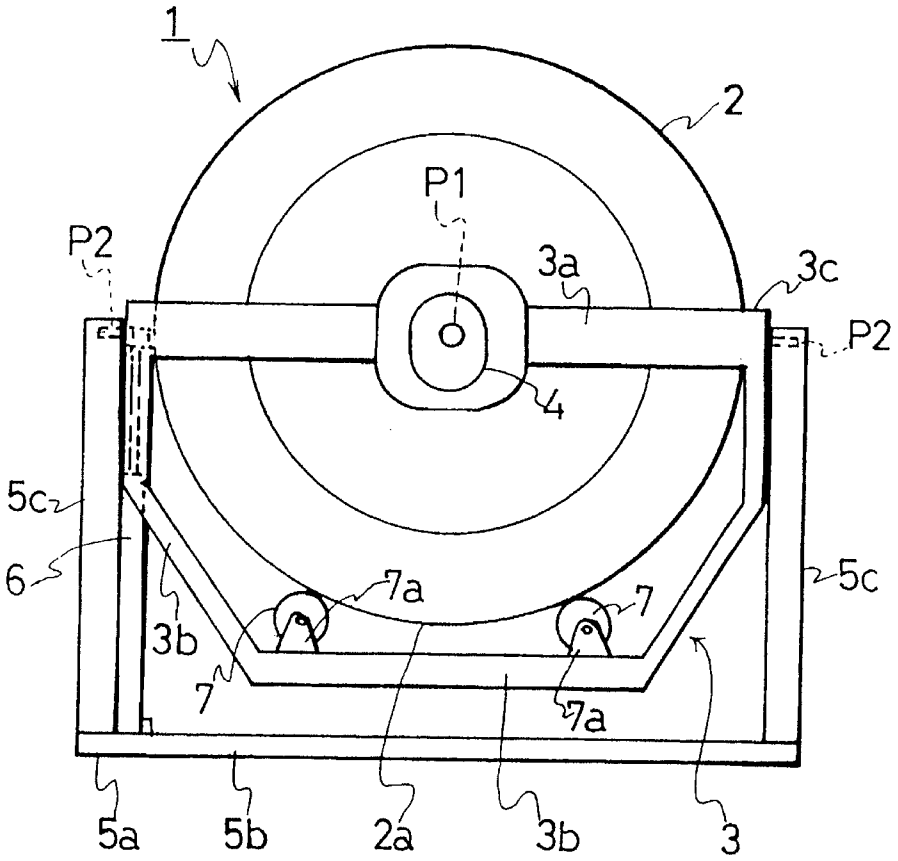
FIG. 2 is a back side view of the asphalt-reclaiming apparatus shown in FIG. 1.

This invention will be further explained with reference to an asphalt-reclaiming apparatus embodying a preferred embodiment of this invention and shown in the drawings as follows.

Figure 1:
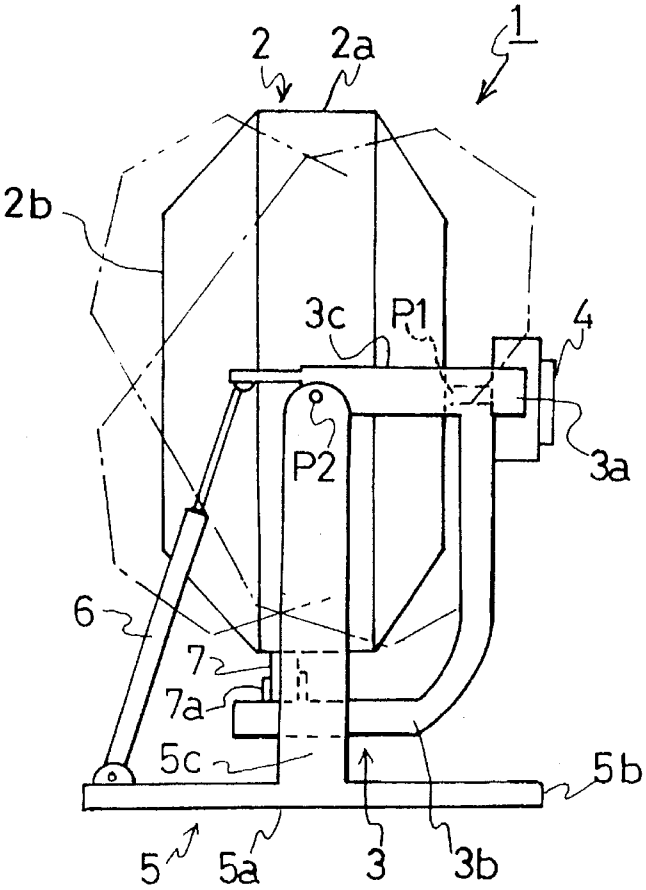
FIG. 1 is a side view showing a preferred embodiment of an asphalt-reclaiming apparatus embodying one example of the conveyable heating apparatus of this invention.

Referring to FIGS. 1 and 2, the asphalt-reclaiming apparatus comprises a combustion chamber 2 having an opening **2*b* constituting both an inlet and outlet for raw material, a holding frame 3 rotatably supporting the combustion chamber 2, an oil pressure motor for rotating the combustion chamber 2, a stand 5 pivotally supporting through the holding frame 3 the combustion chamber 2, and an oil pressure cylinder 6 for effecting the inclination of the combustion chamber 2**.

The combustion chamber 2 is of drum-like shape wherein the middle portion **2*a* is expanded forming an enlarged cylindrical portion and the both end portions are tapered. This combustion chamber 2** is shown as being postured that the opening thereof is turned toward the front.

The holding frame 3 is comprises an integral body consisting of a rear frame **3*a* disposed behind the combustion chamber 2 so as to traverse the center of the back surface of the combustion chamber 2, a lower frame 3*b* extending downward from the both ends of the rear frame 3*a* to below the combustion chamber 2, and a pair of lateral frames 3*c* horizontally extending respectively from the both ends of the rear frame 3*a* toward both sides of the combustion chamber 2. Namely, the holding frame 3 is shaped as such that both ends of the rear frame 3*a* are horizontally and forwardly extended so as to form a pair of lateral frames 3c, and the lower frame 3b is extended downward along the bottom wall of the combustion chamber 2 from both sides of the lateral frames 3c or of the rear frame 3a whereby forming at the distal end portion thereof a horizontal closed arch below the peripheral wall of the combustion chamber 2**.

On the central portion of the bottom of the combustion chamber 2 is protruded out a axis of rotation P1, the distal end of which is rotatably received on the rear frame 3a of the holding frame 3. This axis P1 is adapted to be rotated by the oil pressure motor 4 mounted on the rear frame 3a for rotating the combustion chamber 2.

On the lower frame 3b is erected a pair of brackets 7a set apart from each other. Guide rollers 7 are rotatably mounted on each of the brackets 7a respectively with the rotating direction of the guide rollers 7 being opposite to the rotational direction of the combustion chamber 2. Namely, these guide rollers 7 are contacted with the middle peripheral wall 2a of the combustion chamber 2 whereby supporting the combustion chamber 2 and at the same time guiding the rotation of combustion chamber 2. Accordingly, the combustion chamber 2 is axially supported by the rear frame 3a and is adapted to be inclined integral with the holding frame 3 while being contacted by the guide rollers 7.

A pair of the lateral frames 3c of the holding frame 3 are provided at the middle portions thereof with pivot pins P2, each extending outward and rotatably mounted on a top portion of the stand 5 thereby allowing the holding frame 3 to be rotated around the pivot pins P2.

The stand 5 is composed of a pair of lateral pedestals 5a, each extending back and forth, a rear pedestal 5b disposed between the proximal ends of the lateral pedestals 5a and integrally connected thereto, and a pair of legs 5c, each extending upward from the middle portion of the lateral pedestals 5a and bearing on its top portion the lateral frame 3c. Namely, on the upper portion of each leg 5c is mounted rotatably the pivot pins P2 of the lateral frame 3c.

Meanwhile, an oil cylinder 6 is pivotally disposed between the lateral pedestal 5a of the stand 5 and the arm 3c' of the lateral frame 3c of the holding frame 3. Namely, the distal end of the expandable rod constituting the oil cylinder 6 is pivotally attached to a distal end of the arm 3c' of the lateral frame 3c, and the proximal end of the expandable rod is pivotally attached to a distal end of the lateral pedestal 5a.

These oil pressure motor 4 and oil pressure cylinder 6 are connected respectively to an oil pump (not shown) so that through the manipulation of switches provided on an operation panel, the rotation or halt of the oil pressure motor 4 and expansion or contraction of the oil pressure cylinder 6 can be effected.

At the occasion of charging the combustion chamber 2 with pieces of asphalt, the expansion rod of the oil pressure cylinder 6 is extended pushing the holding frame 3, thus slanting the combustion chamber 2 upward. After finishing the charging with the asphalt pieces through the opening 2b, the combustion chamber is restored through the contraction of the expansion rod to the original standing position, and then the heating of the asphalt pieces is performed by means of burner or microwave generating from a waveguide tube.

During this heating operation, the combustion chamber 2 is rotated by actuating the oil motor 4, the rotation of the combustion chamber 2 being stabilized by the guiding action of the guide rollers 7. With this stabilized rotation of the combustion chamber 2, a uniform and efficient heating of the asphalt pieces can be realized.

When the asphalt pieces are caused to melt sufficiently, the expansion rod of the oil cylinder 6 is contracted to a maximum degree thereby inclining the combustion chamber 2 downward through the rotation of the holding frame 3, thus allowing the molten asphalt to be easily discharged from the opening 2b of the combustion chamber 2.

In the above embodiment, the oil cylinder 6 is provided such that the combustion chamber 2 can be postured in an inclined state at the occasion of throwing asphalt pieces into the combustion chamber 2. However, it is also possible to mount the oil cylinder 6 in such a manner that the opening 2b of the combustion chamber 2 can be turned completely upward (or at an angle of 90 degree upward).

The shape of the holding frame 3 is not restricted to that shown in the drawings. A guiding groove having a U-sectional shape may be provided on the middle peripheral wall 2a of the combustion chamber 2 so as to assure the engagement thereof with the guide rollers. The structure of the stand 5 is not restricted to any particular shape but can be fabricated in any manner as long as it is capable of rotatably supporting the holding frame 3.

Figure 3:
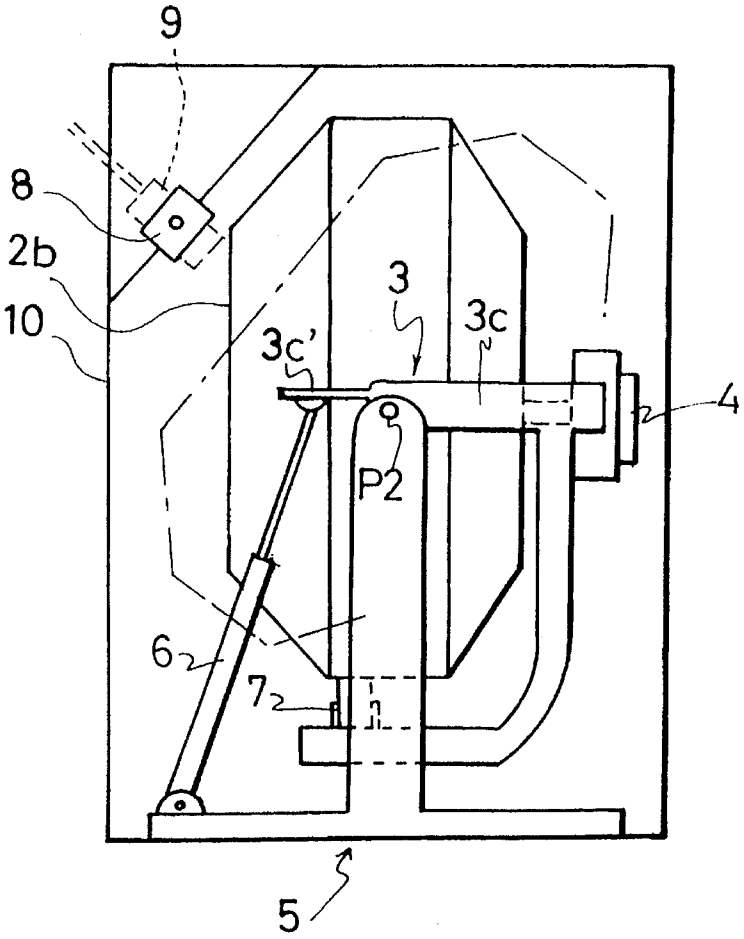
FIG. 3 is a side view illustrating an embodiment wherein the asphalt-reclaiming apparatus is housed in a casing.

Further, if the combustion chamber 2 of this asphalt-reclaiming apparatus is housed within a casing, any accidental contact of an operator with the combustion chamber can be prevented thereby improving the operational safety. FIG. 3 illustrates an embodiment where a casing 10 for housing the combustion chamber 2 is provided to the asphalt-reclaiming apparatus. In this case, a door is attached to the front side of the casing 10 so that the throwing of asphalt pieces into or the withdrawal of the molten asphalt from the combustion chamber 2 may be carried out by opening the door. The door may be provided with a holder 8 so as to allow a burner or a waveguide tube 9 to be held therein.

The casing 10 may be constructed such that it functions also as a stand by rotatably supporting the rotatable axis of the holding frame 3.

The burner or waveguide tube (for microwave heating) may be attached to the casing or combustion chamber through a holder which is detachably fixed to the casing or combustion chamber. Alternatively, the burner or the waveguide tube of a microwave may be attached through a holder to a cover for closing the opening of the combustion chamber. In any case, the distal end of the burner or waveguide tube is directed to the opening of the combustion chamber 2.

Figure 4:
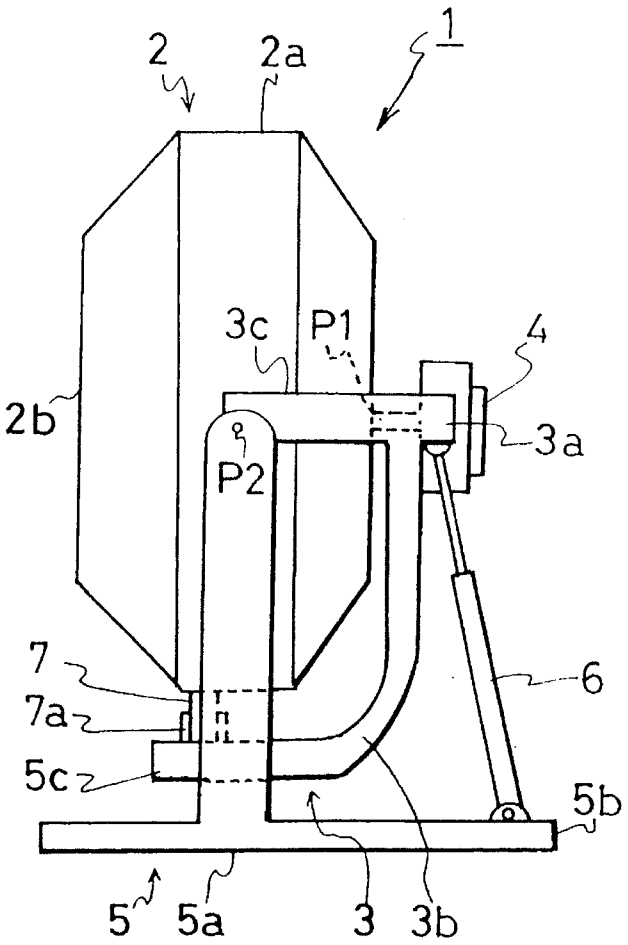
FIG. 4 is a side view showing another embodiment of an asphalt-reclaiming apparatus.

FIG. 4 shows another embodiment which illustrates a modified and simplified lateral frame of this invention.

A pair of the lateral frames 3c of the holding frame 3 are provided at the distal end portions thereof with pivot pins P2, each extending outward and rotatably mounted on a top portion of the stand 5 thereby allowing the holding frame 3 to be rotated around the pivot pins P2.

Meanwhile, an oil cylinder 6 is pivotally disposed between the rear pedestal 5b of the stand 5 and the rear frame 3a of the holding frame 3. Namely, the distal end of the expandable rod constituting the oil cylinder 6 is pivotally attached to a portion of the rear frame 3a near the oil pressure motor 4, and the proximal end of the expandable rod is pivotally attached to a portion of the rear pedestal 5b which is positioned directly below the portion of the rear frame 3a to which the distal end of the expandable rod is attached.

Other construction details are the same as those of the previous embodiment.

Figure 6:
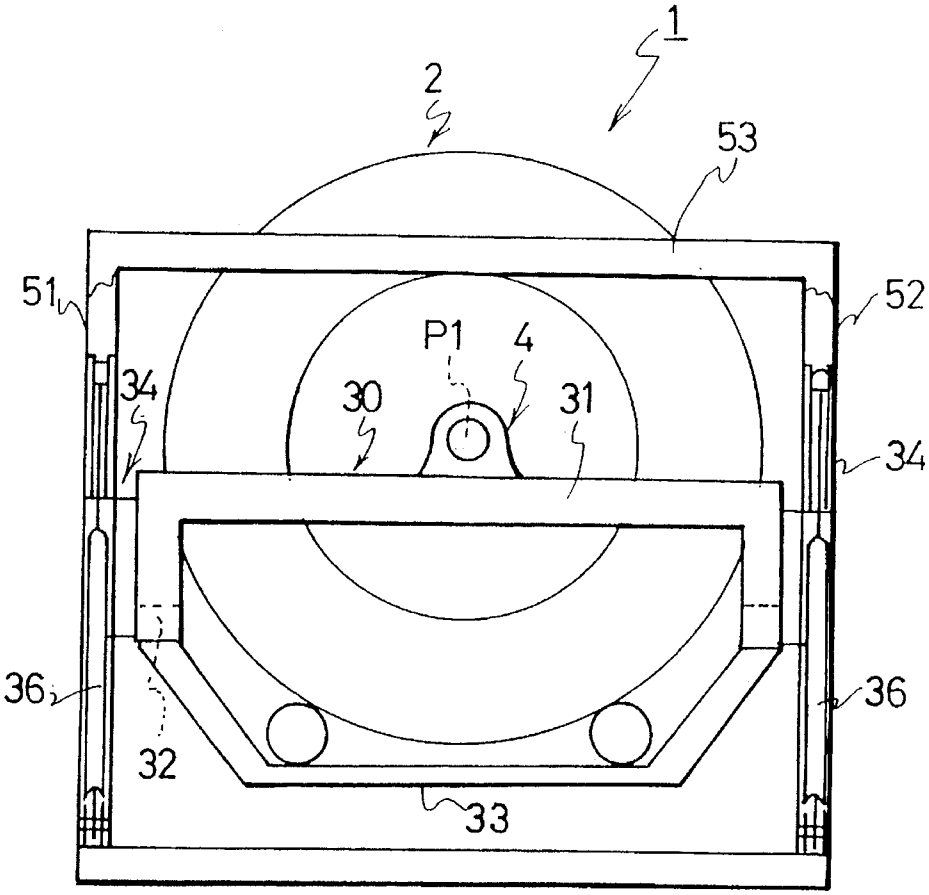
Figure 5:
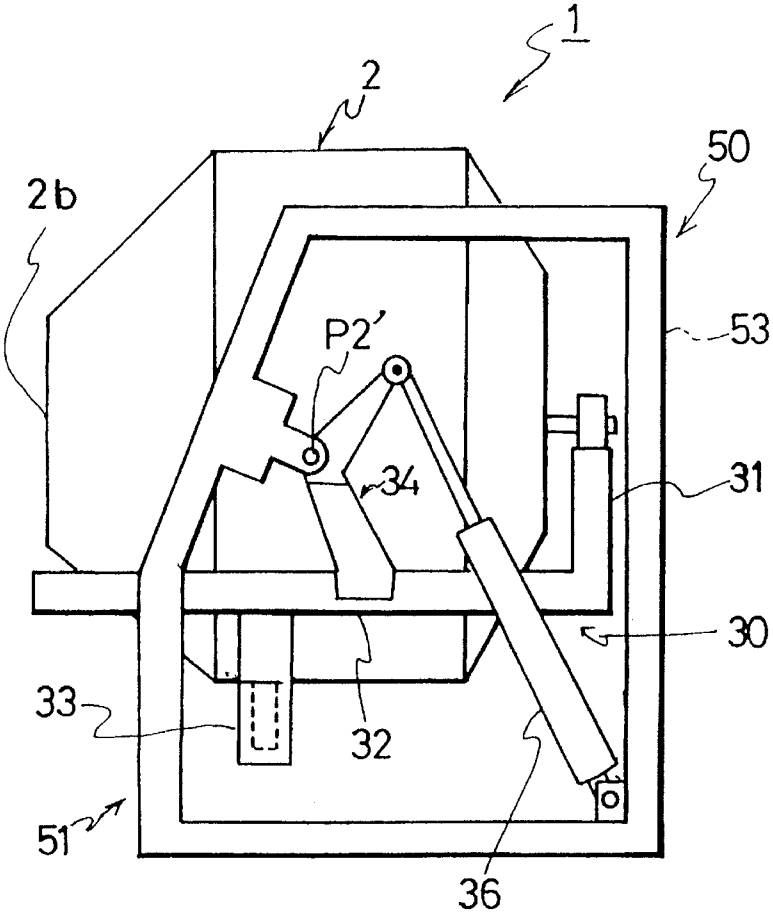
FIG. 5 is a side view showing a different embodiment of an asphalt-reclaiming apparatus; and, FIG. 6 is a back side view of the asphalt-reclaiming apparatus shown in FIG. 5.

FIG. 5 to FIG. 6 show another embodiment.

In this embodiment, a holding frame 30 comprising a rear frame 31 is disposed behind the combustion chamber 2 in such a manner as to traverse near the center of the back surface of the combustion chamber 2. And a pair of lateral frames 32 formed integrally with the rear frame 31 and extending respectively toward both lateral sides of the combustion chamber 2.

The lateral frame 32 having a lever member 34 extending upward from a middle portion of said lateral frame 32, and a stand 50 pivotally connected to a middle portion of said lever 32, and said stand 50 comprises a pair of polygonal frames including a forward frame portion 51 provided with a bracket, and the stand 50 is pivotally connected at pivot P2' via said bracket to a middle portion of said lever arm 34.

The oil pressure cylinder 36 is disposed between a distal end portion of said lever 34 and a base portion of said stand 50.

Other construcaction details are the same as those of the previous embodiment.

In the above embodiments, an oil cylinder is employed as an inclining means. However, it is also possible to employ as an inclining means other kinds of fluid pressure cylinders, a set of gears or an expandable link system which is adapted to cause the holding frame to be inclined from the bottom side of the holding frame.

The heating apparatus according to this invention is not limited to the use for heating pieces of asphalt, but may be employed for heating various kinds of materials including waste materials to be discarded from industries.

According to the conveyable heating apparatus of this invention, the combustion chamber is rotatably supported by means of a stand and holding frame, and the inclination of the combustion chamber upward or downward is effected by displacing the holding frame with respect to the stand by actuating the fluid (oil) pressure cylinder, the combustion chamber being inclined together with the holding frame.

As explained above, the conveyable heating apparatus of this invention is simple in construction and easy in operation for rotating and inclining a combustion chamber so that it is possible to provide a conveyable heating apparatus which is small in size, high in reliability and low in manufacturing cost.

This invention can be modified in any manner within the scope as claimed in the following claims.

What is claimed is:

1. A conveyable heating apparatus comprising:

a combustion chamber having an open top, a holding frame comprising a rear frame disposed on a side thereof opposite said open top, in such a manner as to traverse near the center of the back surface of the combustion chamber and a pair of lateral frame members formed integrally with the rear frame and extending respectively toward both lateral sides of said combustion chamber, said at least one of said lateral frame members having a middle portion and a lever extending upward from said middle portion of said at least one of said lateral frame members, a shaft extending from the bottom of the combustion chamber for revolving the combustion chamber, the shaft being adapted to be rotated by a driving device, a stand pivotally connected to said middle portion of said lever, and a fluid pressure cylinder disposed between a distal end portion of said lever and a base portion of said stand.

2. The conveyable heating apparatus according to claim 1, wherein said stand comprises a pair of polygonal frames including a forward frame portion provided with a bracket, and said stand being pivotaly connected via said bracket to said middle portion of said lever.

* * * * *